United States Patent [19]

Lowe

[11] 4,389,191

[45] Jun. 21, 1983

[54] APPARATUS FOR MOVING A VESSEL HEATER COVER

[76] Inventor: Richard L. Lowe, 1906 Shaler Dr., Glenshaw, Pa. 15116

[21] Appl. No.: 298,502

[22] Filed: Sep. 1, 1981

[51] Int. Cl.[3] ..... F27D 1/18; F27B 14/00

[52] U.S. Cl. ..... 432/250; 49/241; 49/246; 49/247; 49/248; 49/340; 110/177; 266/275; 432/156

[58] Field of Search ..... 432/156, 250; 266/275, 266/276; 110/176, 177; 49/240, 241, 246, 247, 248, 339, 340

[56] References Cited

U.S. PATENT DOCUMENTS

| | | | |
|---|---|---|---|
| 2,639,144 | 5/1953 | Long | 49/246 |
| 3,536,343 | 10/1970 | Casperson et al. | 432/156 |
| 3,930,786 | 1/1976 | Bloom | 432/210 |
| 4,014,532 | 3/1977 | Holley | 266/287 |
| 4,183,305 | 1/1980 | Payne | 432/250 |

FOREIGN PATENT DOCUMENTS

| | | | |
|---|---|---|---|
| 562711 | 1/1976 | U.S.S.R. | 432/250 |

*Primary Examiner*—John J. Camby

*Attorney, Agent, or Firm*—Buell, Blenko, Ziesenheim & Beck

[57] ABSTRACT

Apparatus for moving a vessel heater cover including upper linkage, lower linkage and a bell crank. The bell crank is pivotally secured to the upper and lower linkage. The lower linkage includes first and second pivot points. The first pivot point connects the lower linkage with the cover and the second pivot point connects the lower linkage with the connector link. A source of power is provided for effecting rotation of the connector link about the second pivot. Counterweights may be provided and be pivoted about the second pivot. The first pivot may include a gimbal providing two axes of rotation for the cover disposed generally perpendicular to each other. Compressible insulation in the cover may project downwardly to provide automatic sealing with the vessel cover. The mechanism provides automatic compensation for misalignment between the vessel rim and the cover.

24 Claims, 13 Drawing Figures

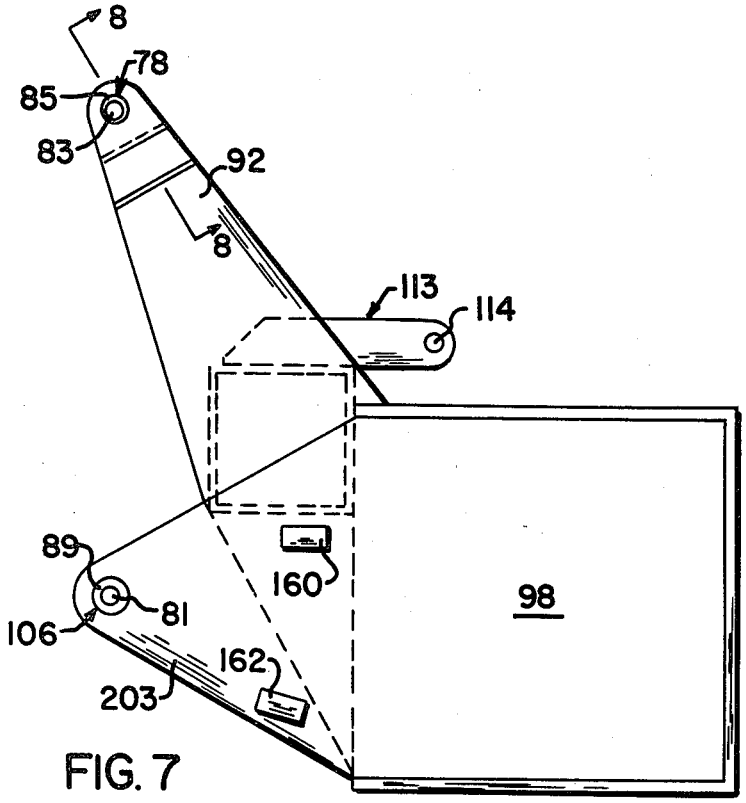
FIG. 7
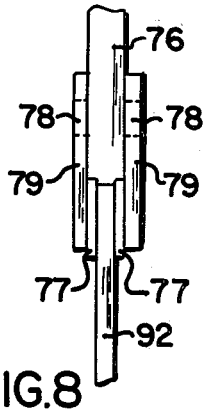
FIG. 8
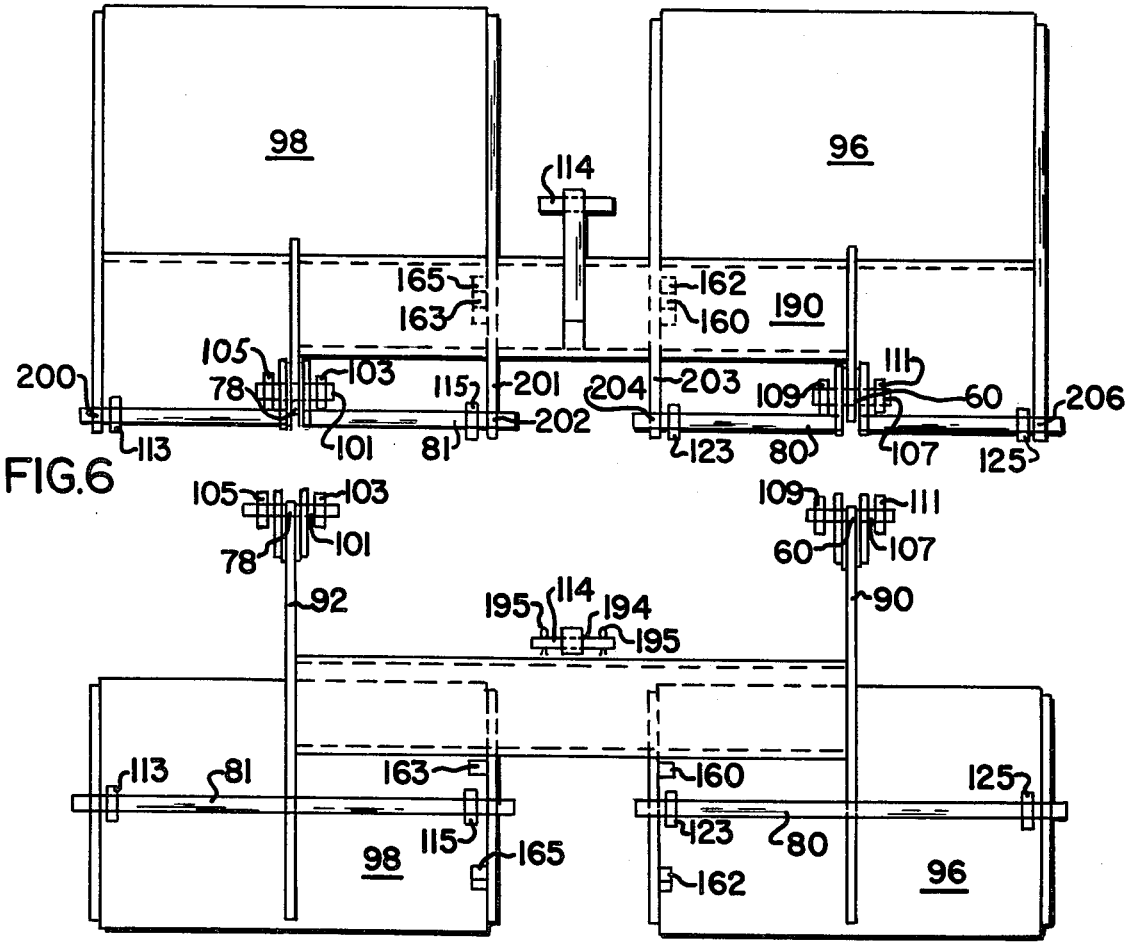
FIG. 6
FIG. 5

APPARATUS FOR MOVING A VESSEL HEATER COVER

BACKGROUND OF THE INVENTION

1. Field of the Invention

This invention relates to apparatus for moving a vessel heater cover into and out of vessel heating position and, more specifically, relates to such apparatus which is adapted to compensate automatically for vessel rim misalignments and means for providing a resilient seal between the vessel and cover.

2. Description of the Prior Art

In connection with heaters employed with vessels, as hereinafter defined, it has been known to provide for single-hinge construction which permits a cover element to rotate about a unitary axis between a functioning and nonfunctioning position.

One of the problems encountered with such known ladle heaters has been the fact that where it is desired to contact or seal the ladle heater cover against the ladle, in many instances due to lack of uniformity of the upper surface of the ladle, irregularities in the supporting structure for the ladle or other causes of relative misalignment between the ladle heater cover and ladle, the desired, uniform, annular contact between the ladle heater cover and ladle cannot be effected. This results in inefficient ladle heating and waste of energy employed in energizing the ladle heater burner.

Another problem encountered prior to this invention has been excessive pressure being applied to the resilient but fragile cover insulating material resulting in permanent deformation of the insulation and loss of sealing effectiveness.

Another problem with known vessel heaters is the excessive physical space required for the entire heater due to the lack of efficient and compact mechanisms.

Yet another problem with known vessel heaters is the lack of integral means to guide the vessel into correct operating position without excessive maneuvering with an overhead crane or similar lifting device.

Still another problem with known vessel heaters is the lack of protective shielding for sensitive components against splashing molten metal, physical damage, or sources of extreme heat. It is desirable to provide means of isolating such sensitive components from such sources of damage, and to locate operative devices in a protective area for the convenience and safety of personnel during operation and maintenance.

There remains, therefore, a real and substantial need to provide effective solutions to the above-described problems.

SUMMARY OF THE INVENTION

The present invention has met the above-described need by providing a unique multiple pivot construction which permits effective movement of a vessel heater cover between the operating and nonoperating positions, while permitting automatic adjustment for misalignment between the vessel heater and vessel including irregularities in the upper vessel surface.

Upper linkage means are secured to the cover as are lower linkage means. Bell crank means are pivotally secured to the upper linkage means and lower linkage means. The lower linkage means includes first pivot means connecting the lower linkage means with the cover and second pivot means connecting the lower linkage means with the bell crank means. Power means effect rotation of the bell crank means about the second pivot means. Counterweight means may also be provided and be pivotally secured to the second pivot means.

It is an object of the present invention to provide a vessel heater cover operating apparatus which will effectively, automatically compensate for irregularities in alignment or construction and provide an effective seal between the vessel heater cover and the vessel.

It is a further object of this invention to provide such apparatus which through multiple hinging action will effectively control movement of the vessel heater cover.

It is another object of the invention to provide such apparatus which includes counterweight means.

It is yet another object of the present invention to provide such apparatus which is adapted to be employed with otherwise conventional vessel heaters and vessels.

It is another object of the present invention to provide apparatus for obtaining an effective seal between the vessel heater cover and vessel surface while protecting the insulation material from damage.

It is another object of the present invention to provide integral guides to allow automatic positioning of the vessel.

It is another object of the present invention to provide protective shielding between the vessel and sensitive components of the heater.

These and other objects of the invention will be more fully understood from the following description of the invention on reference to the illustrations appended hereto.

BRIEF DESCRIPTION OF THE DRAWINGS

FIG. 5 is a front elevational view of a counterweight arrangement of the present invention.

FIG. 6 is a top plan view of the counterweight shown in FIG. 7.

FIG. 7 is a right side elevational view of a form of bell crank means and counterweights of the present invention.

FIG. 8 is a cross sectional illustration taken through 8—8 of FIG. 7 showing a portion of the connector link means.

DESCRIPTION OF THE PREFERRED EMBODIMENTS

The term "vessel" as used herein shall include but not be limited to ladles, crucibles, molds, troughs, boxes, pots and other vessels for receiving molten metal, holding scrap metal to be heated, or otherwise requiring or making desirable the application of heat to the internal cavity or contents thereof.

The term "vessel heater" as used herein shall include but not be limited to heaters used to heat "vessels" as defined hereinabove or the contents thereof or for drying or curing refractory portions thereof.

Figure 1:
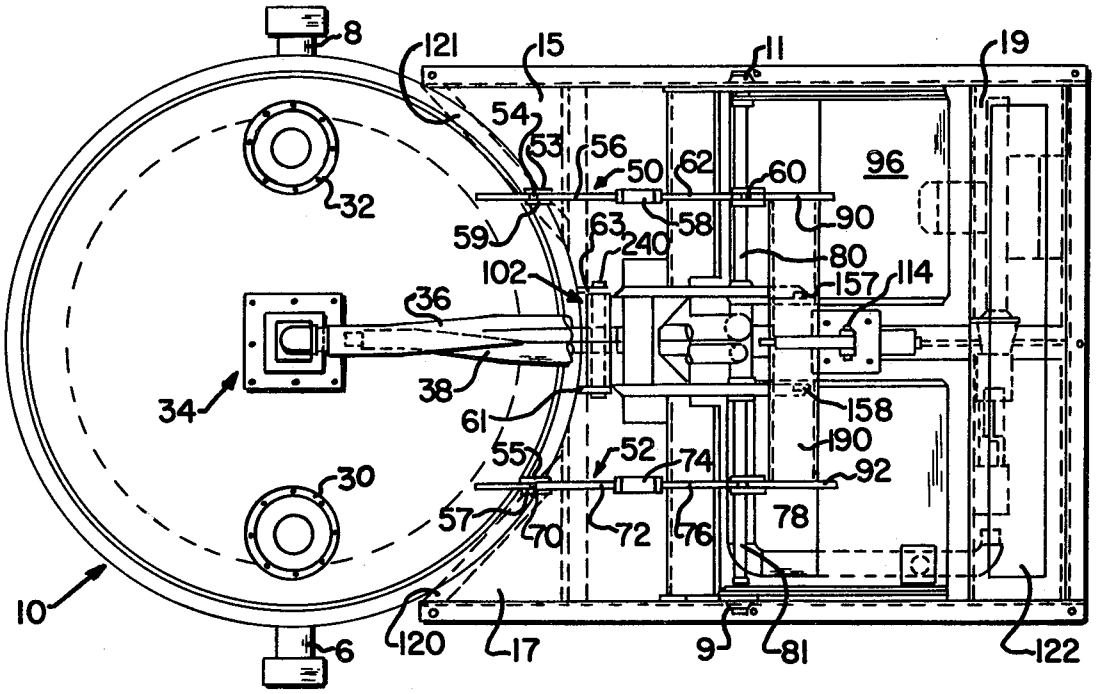
FIG. 1 is a top plan view of a form of the apparatus of the present invention and a vessel.
Figure 2:
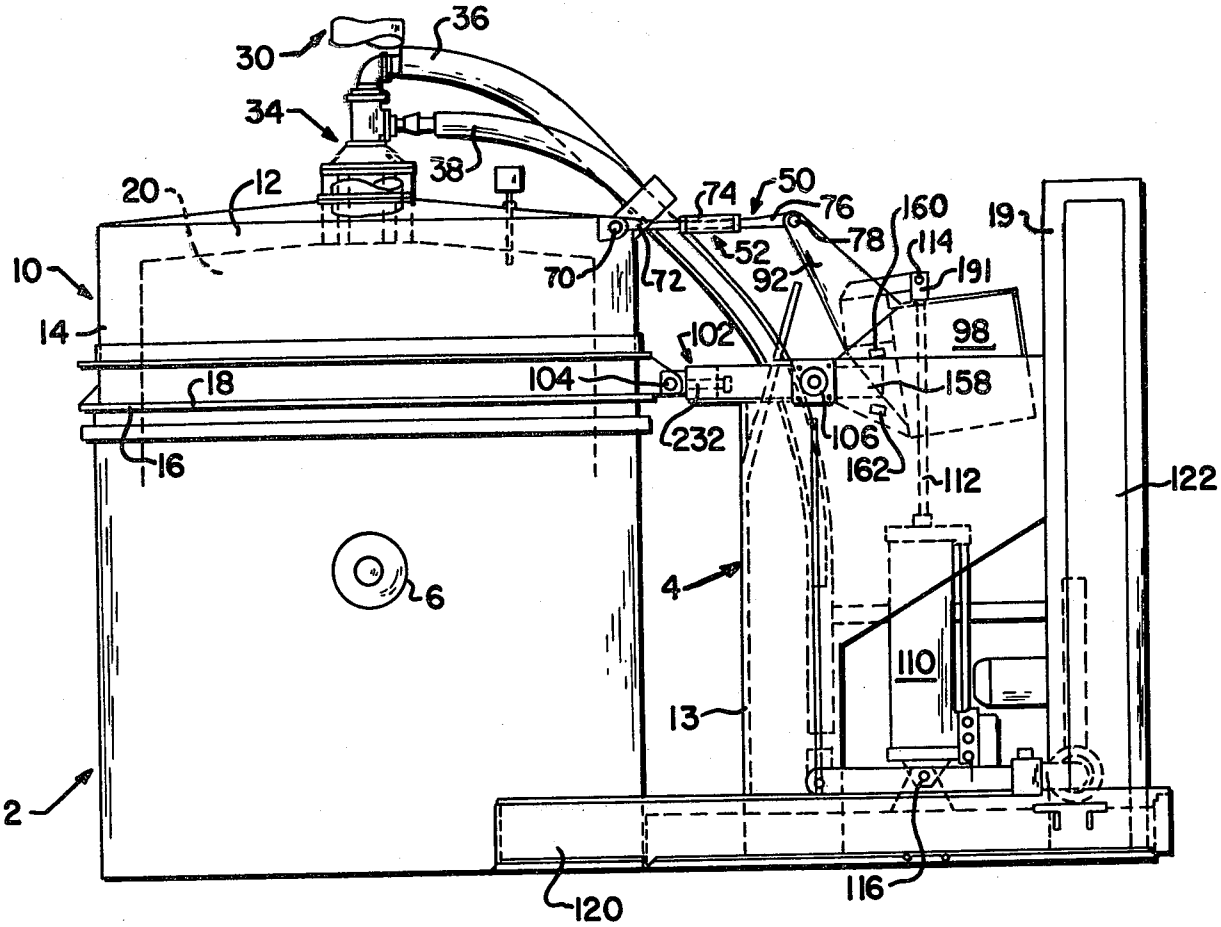
FIG. 2 is an elevational view of the apparatus shown in FIG. 1 showing the cover in closed position.

Referring now more specifically to FIGS. 1 and 2, there is shown a vessel 2 which is generally cylindrical and has a pair of opposed crane-engaging trunions 6, 8 on opposed side thereof.

The top surface or rim of the vessel is designated 18. Referring still to FIGS. 1 and 2, the main frame 4 serves to support the main pivot through bearings 9, 11. The lower portion of the frame at the front includes a saddle-like configuration 120, 121 for the guidance and positioning of vessel 2 into proper operating position. Shielding 13 provides a barrier to resist entry of heat, splashing molten metal, or other source of damage, from operators, sensitive mechanisms, controls, and the like located rearward of the shield. Shields 15, 17 (FIG. 1) cover the lower portion of the frame structure and prevent molten metal or other debris from by-passing shield 13 at that point. Panel 19 is located at the rear of the heater and houses most of the combustion equipment and electrical controls, and serves as a second shield to offer additional protection for the equipment and operator.

The vessel heater, in the form shown, has a cover 10 which has an upper wall or roof 12 and depending annular circumferential wall 14 which terminates in an annular base 16. The annular base 16 engages the upper edge 18 of the vessel 2 when the cover is in the operating position as is shown in FIG. 2. In this form of vessel heater the recess provided by the depending circumferential wall 14 defines a combustion chamber 20 between the burner 34 and the vessel 2. If desired, however, other types of covers including disk-like covers on which the linkage of the present invention has been mounted as by direct securement or suitable attaching members, may be employed. The vessel heater cover in other respects is conventional in its configuration and can take many forms. The primary cover opening or surface that mates to the vessel can be round, oval, square, hexagon, rectangular, or any geometrical shape desired. The cover can be co-planer without primary opening or can have a raised roof with sidewalls for added combustion space, and may contain the usual secondary openings for one or more burner, one or more exhaust flues, thermocouple ports, sight ports, or other openings as desired.

The upper wall 12, in the form shown, contains three openings. The first of which cooperates with burner 34 to permit the flame to be projected downwardly through roof 12. On opposite sides of the burner 34 are a pair of flue pipes 30, 32 which are in communication with combustion chamber 20 through openings in roof 12. Hoses 36, 38 are employed to supply the required air and natural gas for fueling the burner 34.

As will be described hereinafter, the present invention employs a combination of an upper linkage which serves to restrain the cover 10 against uncontrolled movement, particularly during the closing operation and a lower linkage which provides a plurality of pivots in order to facilitate seating the cover 10 on the vessel 2. All of this is accomplished through bell crank means which, in the preferred embodiments are powered by a pneumatic or hydraulic cylinder 110.

Referring still to FIGS. 1 and 2, it is noted that the cover 10 is in the down or operating position with the lower flange 16 in engagement with the upper portion 18 of vessel 2. The upper linkage consists of a pair of linkage members 50, 52 which have one end in engagement with the cover 10 and the other end in engagement with the bell crank means through pins 60, 78. As is shown in FIGS. 1 and 2, upper linkage 50 consists of a pivoted connection between cover 10 and rod 56, with the pivoted connection being designated 54. A second rod portion 62 is pivotally connected at 60 to link 90 of bell crank means. In the preferred embodiment, the length of upper linkage 50, 52 is adjustable and such adjustment may be provided by internally threaded sleeve 58 which is threadedly engaged with external threads (not shown) on rods 56, 62. Similarly, upper linkage 52 is pivoted about 70 and 78 and includes rods 72, 76 which are threadedly connected to threaded sleeve 74. Link 92 of bell crank means is pivotally connected to rod segment 76 about pivot 78. It will be appreciated that for a given position of connecting links 90, 92 the upper linkage means 50, 52 will serve to resist uncontrolled movement of cover member 10.

Referring still to FIGS. 1 and 2, it will be noted that a pair of counterweights 96, 98 connected by beam 190 are fixedly secured to bell crank links 90, 92. These counterweights 96, 98, in a fashion which will be described hereinbelow, serve to provide a moment opposed to the downward movement of the cover 10 and, may be so selected as to provide sufficient weight as to counteract the moment which tends to pull the cover downwardly thereby providing an extra control feature for smooth movement of the cover, should there be a failure in the power supply means. Should such failure occur or should there be a fracture in certain portions of the apparatus, the tendency will be for the cover 10 to move into its upward position as distinguished from possible rapid movement downward into contact with the vessel rim 18.

As is shown in FIGS. 1 and 2 the lower linkage 75 connects at one end to the lower cover pivot through shaft 240 and pivots about the main shafts 80, 81. The lower linkage 102 consists of a first lower pivot means 104 and a second lower pivot means 106. As will be described hereinafter, the second pivot 106 by means of a main shaft 80 (FIG. 1) permits rotation of the bell crank means 90, the counterweight means 96, 98 and the first lower pivot 104 with respect thereto.

Referring again to FIG. 4, a preferred refinement of the present invention will be disclosed. As is shown, the cover 10 in general is provided with a steel outer shell 143 and a resilient refractory or other thermally insulative inner material such as a ceramic fiber, for example. The number of flues are variable but in this case twin flues 30, 32 are disposed on the opposite sides of singular burner-receiving opening 140, although multiple burners may be employed, if desired. As will be noted, the insulating material 145 extends at the lower end 148 to a level below the level of steel flange 146 which is also preferably annularly substantially continuous. It is preferred that this downward projection of portion 148 extends a minimum of about $\frac{3}{8}$ inch. This projection serves to assist with obtaining effective contact between the upper edge 18 of the vessel 2 and the lower portion of the cover thereby to resist undesired loss of heated air obtained through the action of the burner.

Upon movement of the cover into operating position, the resilient insulation 148 contacts the vessel rim 18 and deflects according to the irregularities in the vessel rim surface. Deflection of the insulation 148 is limited by the eventual contact of the cover flange 146 and vessel rim surface 18. The cover 10 is free to move in all axes until the flange 146 settles on three or more points on the vessel surface at which time the flange 146 supports the combined weight rather than the insulation 148 while an effective seal is established. If desired, the preferred use of a flange 146 could be eliminated thus allowing the resilient insulation 148 to support the force of the cover 10 against the vessel at some risk of damage to the insulation, with this effect being somewhat minimized with very precise and proper arrangement of counterweights, center of gravity, rotational power source and speed.

Figure 4:
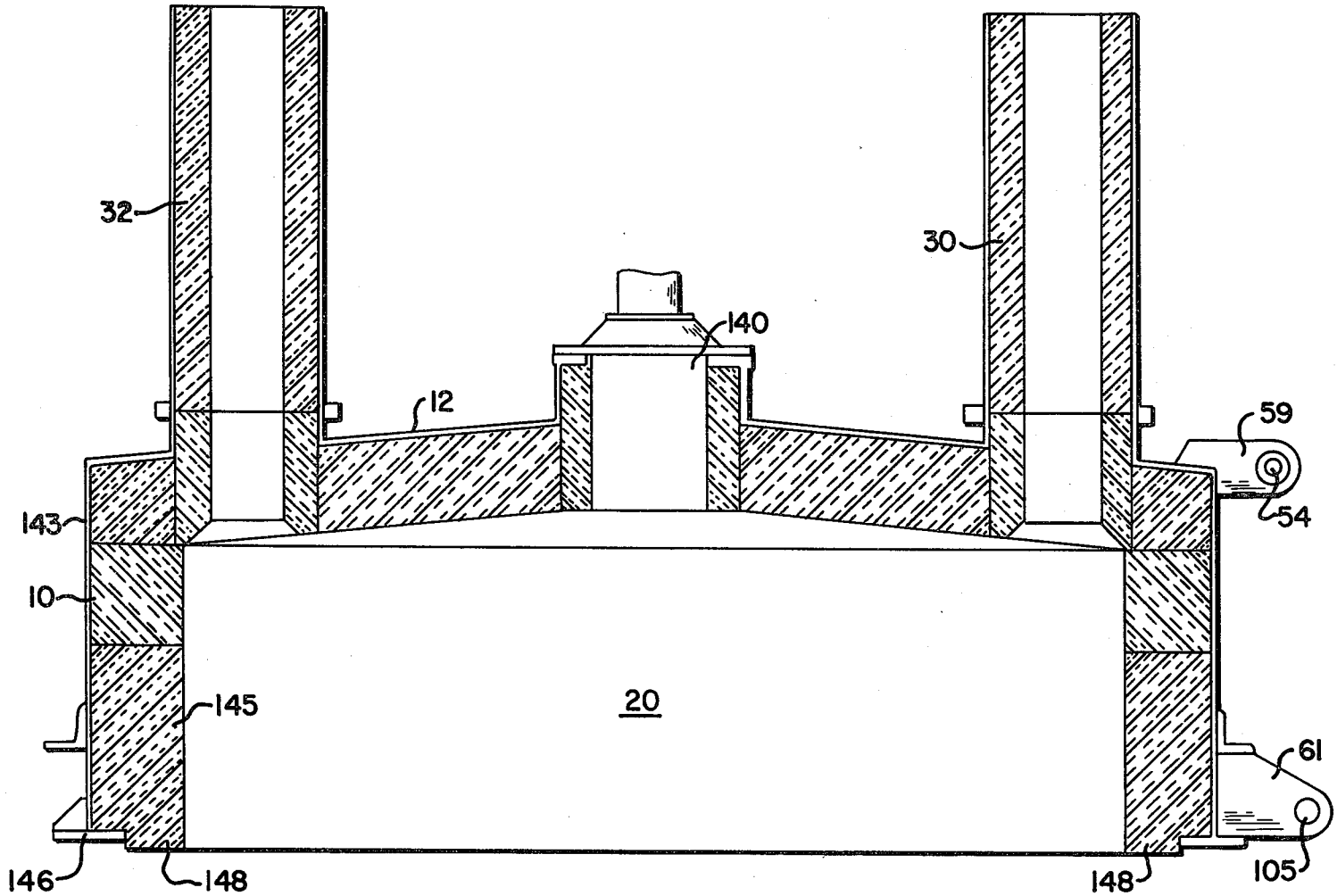
FIG. 4 is a cross sectional illustration of a cover usable in the present invention.

Referring still to FIG. 4, the cover has two upper pivot clevises composed of plates, each having side plates 53, 55, 57, 59 and accepting pivot pins 30, 54, 70. The cover also has two lower pivot clevises 61, 63 serving as attachment for lower linkage means.

As a further component of the bell crank means a pivot 114 which provides a clevis attachment to piston rod 112 is fixedly secured to the bell crank assembly. Pneumatic cylinder 110 has a piston rod 112 with its free end pivotally secured to pivot 114. In the form shown in FIG. 2 with the piston rod 112 projecting from the cylinder 110, the cover 10 will be in a closed position. As the piston rod 112 moves out of the cylinder 110 in moving toward the position shown in FIG. 2, the cover, upper linkage, lower linkage, bell crank means and counterweight assembly are subjected to counterclockwise rotational movement about main pivot 106. In the event of improper seating of the lower flange 116 of cover 10 on the upper edge 18 of the vessel 2, the gimbal structure provided by the pivot assembly 104 permits rotation of the cover 10 about either or both of two substantially perpendicular axes of rotation provided by the gimbal at pivot 104.

As is shown in FIGS. 1–3 and 6–7, in order to prevent excess rotation of the lower linkage means 102 about pivot 106, extensions 157, 158 of lower linkage means 102 are adapted to contact stop members 160, 162, 163, 165 which are secured to the bell crank means. Generally, in effecting removal of the cover 10 from the position shown in FIG. 2, the bell crank means will be subjected to clockwise rotation until stop members 160, 162 contact extensions 157, 158 at which point all elements will rotate about main pivot 106.

Figure 3:
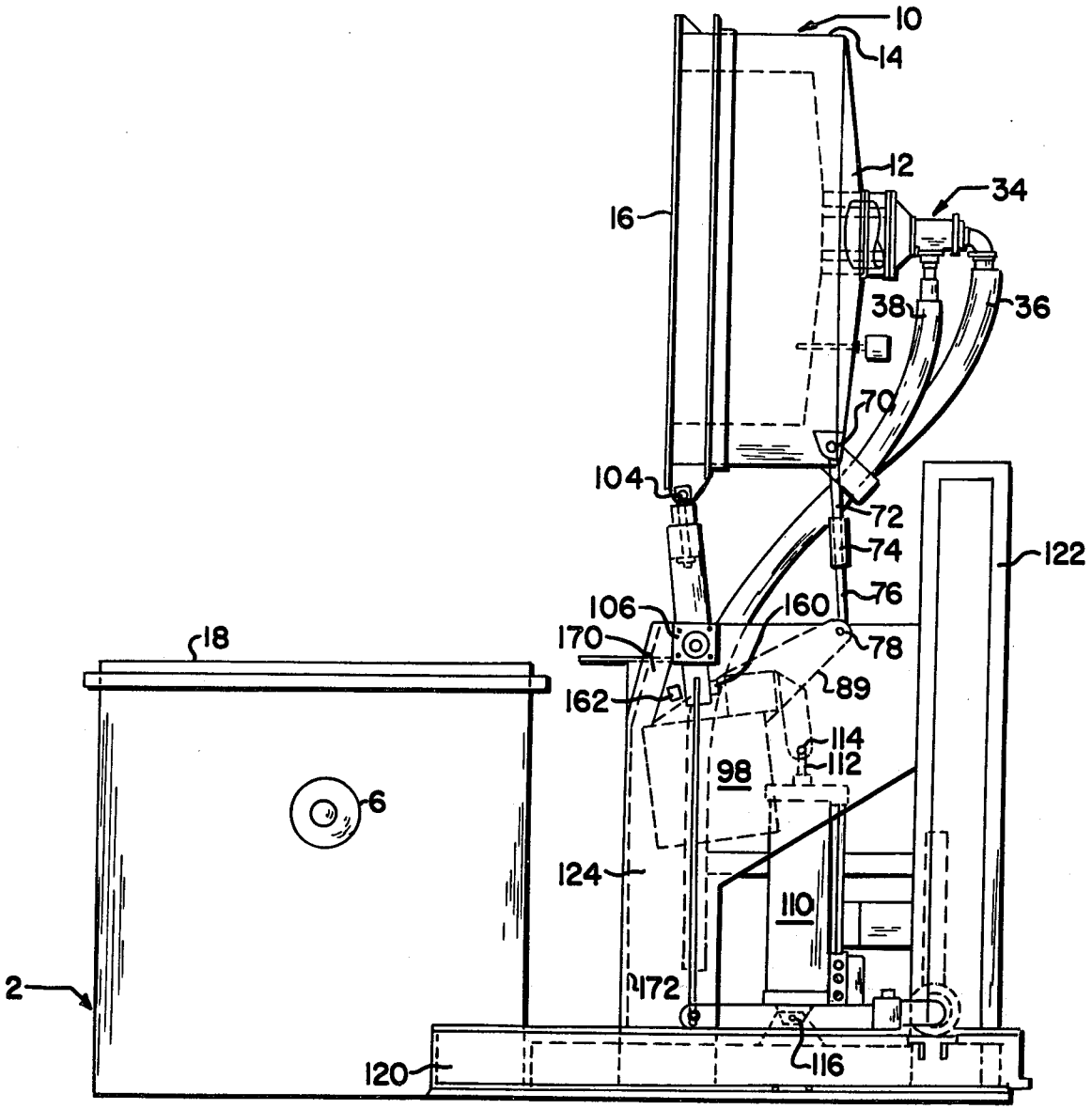
FIG. 3 is an elevational view similar to FIG. 2 but showing the cover in raised position.

Referring now to FIG. 3 there is shown the assembly substantially identical to that of FIG. 2, but with the cover 10 in the raised position. It will be noted that the piston rod 112 has been retracted into the cylinder 110 and the counterweights 96, 98 and associated bell crank means have been rotated clockwise to the position shown in FIG. 3. It is noted that the base of cylinder 110 is positioned in a clevis 116 mounting thereby permitting rotation of the cylinder in a clockwise direction during retraction of the piston rod 112 with return of the cylinder 110 to a vertical position after retraction. Also shown in this view, as well as FIGS. 1 and 2, are the saddle-like base 120, 121 which serves to provide a recess for receipt of the lower portion of the vessel 2 and a control panel 122 which contains the operative controls and has its controls facing generally away from the direction of the vessel. Support frame 124 serves to provide structural support for the linkage mechanism disclosed herein. It is noted that a shield or splash guard 170, 172 has been positioned intermediate the vessel 2 and the linkage and control mechanisms.

FIGS. 5 and 6 will now be referred to in order to provide a detailed description of the counterweight assembly construction. As is shown in these figures, the counterweights 96, 98 are fixedly secured to the bell crank means and are formed into a unit by means of connection beam 190 which is secured to the counterweights 96, 98 by any desired means, as by welding. In this fashion, it will be appreciated that the counterweight means will remain relatively fixed with respect to each other and with respect to the bell crank means, all of which may be rotated about main pivot 106.

In FIGS. 5 and 6 projecting upwardly are the link elements 90, 92 which support, respectively, shafts 107, 101 and associated retainer collars 103, 105, 109, 111. Also shown in these figures are retainer collars 113, 115, 123, 125 which are secured to main shafts 80, 81 and pin 114 which secures link 113 to piston rod clevis 191.

Referring now to FIGS. 7 and 8, further discussion of the details of the bell crank means will be provided. As is shown, in general it is contemplated that the structure will rotate as a unit and thereby permit the desired responsive movement of the cover through the linkage which has been described above and will be described in greater detail hereinafter. Bell crank means in the form shown consists of counterweights 96, 98 connected by beam 190 between upper levers 90, 92. Levers 90, 92 have clevises attached by welding side plates 79 to spacer plates 77, and in turn to levers 90, 92. Upper lever clevises include pins 83 and shaft collars 85 for attachment of upper linkage means. Lower levers 201, 203, are welded to counterweights 96, 98 and contain holes to slidingly accept main shafts 80, 81. Shaft collars 89 are slidingly placed on the main shafts 80, 81 to contain same in assembly with other parts. Stops 160, 162 are secured to lower levers 201, 203 to provide limited rotation of the lower linkage with respect to bell crank means. Lever 113 is secured to beam 190 and contains pin 114 for attachment of air cylinder clevis 191.

Figure 9:
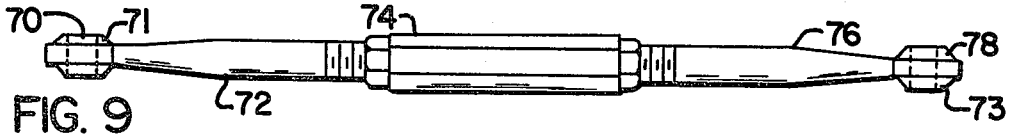
FIG. 9 is a front elevational view of a form of upper linkage means of the present invention.
Figure 10:
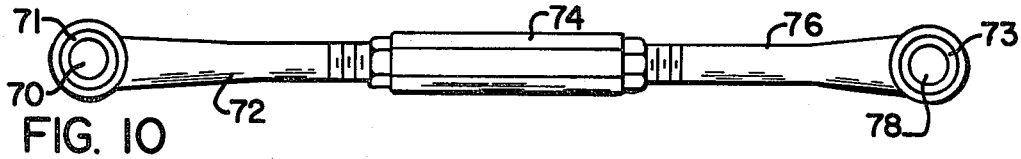
FIG. 10 is a top plan view of the linkage means shown in FIG. 9.

FIGS. 9 and 10 illustrate details of a preferred form of link for use in upper linkage means 50. The pivot openings 70, 78 which are defined by bearings 71, 73 are, respectively, connected to rod sections 72, 76 which in turn have external threads threadedly engaged with internal threads of sleeve member 74. By rotating the sleeve 74 with respect to rods 72, 76, the rod sections 72, 76 are either urged into relatively closer position or relatively farther position with respect to each other.

Figure 11:
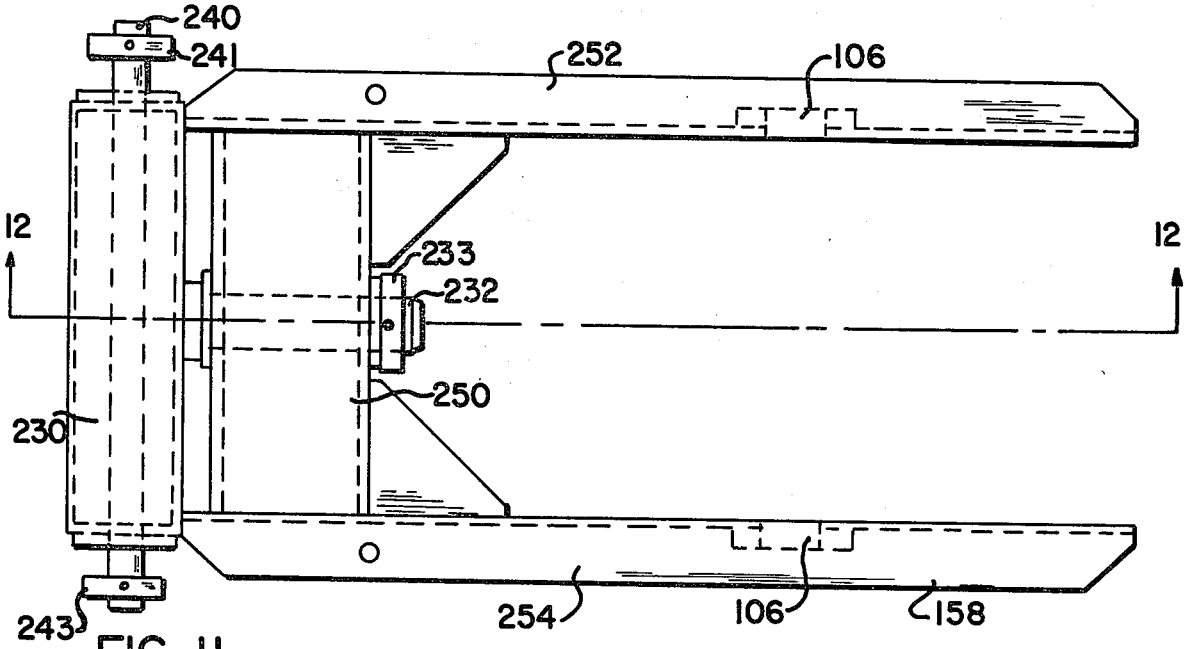
FIG. 11 is a top plan view of a portion of the lower linkage means.
Figure 12:
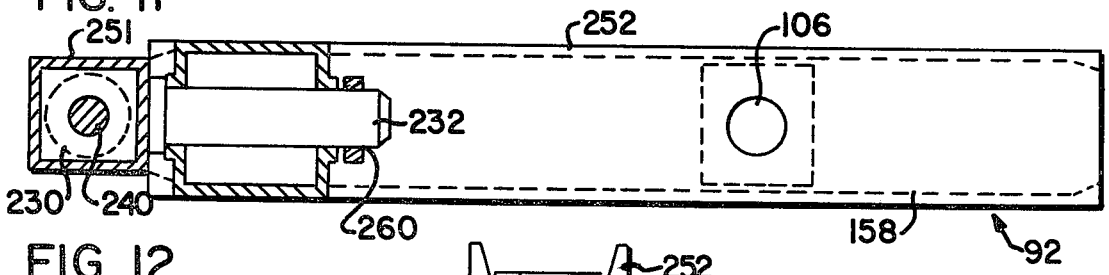
FIG. 12 is a front elevational view of the lower linkage means shown in FIG. 11.
Figure 13:
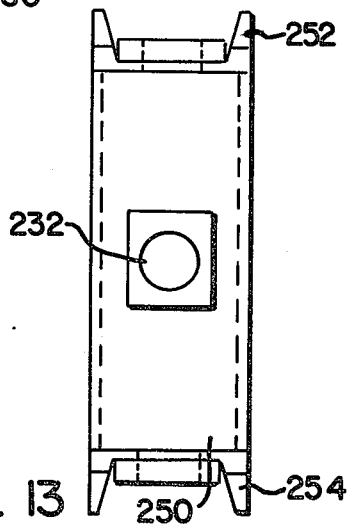
FIG. 13 is an end elevational view of the portion of the linkage means shown in FIG. 11.

Referring once again to FIGS. 1 and 2 and additionally to FIGS. 11 through 13, the gimbal action of the first lower pivot 104 will now be considered in greater detail. As is shown in FIGS. 11 and 12, the pivoting element provided at 104 consists of a generally T-shaped member having connected legs 230, 232 which are oriented generally perpendicularly with respect to each other. The central axis of leg 230 will have a bore receiving shaft 240 which is retained by collars 241, 243. The shaft will generally be coaxial with pivot 104. The rearwardly directed leg 232 will be retained by collar 233 and will generally be substantially horizontally disposed and projecting in a direction away from the vessel 2, as is shown in FIG. 2, with the cover 10 in closed position. It will be appreciated that once the cover 10 has made contact with a portion of the vessel, rotation of the assembly about pivot 106 will in general be terminated and further rotation about the first lower pivot 104 will be permitted. Depending upon the nature of the irregularity which has caused improper seating between the cover 10 and vessel 2, rotation about the axis of either leg 230 or leg 232 or both may be required in order to effect proper seating. While the use of a gimbal is preferred, depending upon the degree of freedom of movement desired, other means may be substituted. Mechanisms such as a ball joint, universal joint or similar device, for example, may be employed.

The keeper member which serves to retain the lower linkage means in position and forms a portion thereof is shown in FIGS. 11 through 13. It will be appreciated that the keeper has a base portion 250, a tubular extension 251 and a pair of projecting legs 252, 254 which are spaced from each other and connected to opposed ends of base 250. The leg 230 of gimbal member will be received within extension 251 with the leg 232 passing through base 250, extending between legs 252, 254 and projecting in the same direction. Shafts 80, 81 will pass through openings 106 and rear extensions 157, 158 will be disposed between the stop members 160, 162, 163, 165 (FIG. 5). As is shown in FIG. 13, opening 260 permits communication between base 250 and the space between legs 252, 254 for passage of leg 232 therethrough.

The functions of the mechanism and compressible insulation in cover closing action will be considered. As the cover pivots about main shafts 80, 81 with the bell crank means rotating in a counterclockwise direction, motion continues as the resilient insulation projecting portion 148 contacts the vessel surface 18 and compresses until the cover flange 146 contacts the vessel surface 18 at a point generally nearest the main pivot because at this point the cover 10 is held in a slight backward tilted position clockwise about the lower cover pivot. As the bell crank means continues in counterclockwise motion the cover 10 now pivots on the rearward contact point between the cover flange 146 and vessel surface 18 and the forward portion of cover 10 settles in counterclockwise motion until cover flange 146 has contacted the vessel surface 18 at the forward point. In the event of improper seating of the lower flange 146 of cover 10 on the upper edge 18 of the vessel 2, the motion provided by the gimbal action of lower linkage permits rotation of the cover 10 about either or both of two substantially perpendicular axes of rotation 230, 232 and the cover 10 is permitted to settle onto the vessel surface 18 in that axes as well. The combination of linkage and gimbal movement allows the cover to settle into the vessel regardless of the axes of misalignment.

It will be appreciated that while hydraulic or pneumatic cylinders are among the preferred types of power means employable in the present invention, other means such as electric motors, for example, may be employed if desired.

It will be appreciated, therefore, that the present invention provides an effective means for controlling movement of a vessel heater cover into and out of operating position while permitting automatic adjustment for irregularities in relative positions of the cover and vessel or irregularities in the vessel per se. All of this is accomplished without interfering with the basic controls or other aspects of the vessel heating operation.

Whereas particular embodiments of the invention have been described above for purposes of illustration it will be appreciated by those skilled in the art that numerous variations of the details may be made without departing from the invention as described in the appended claims.

I claim:

1. Apparatus for moving a vessel heater cover comprising a vessel heater cover, generally horizontally oriented upper linkage means secured to said cover, at a first elevation, generally horizontally oriented lower linkage means secured to said cover, at a second elevation, said first elevation being higher than said second elevation, bell crank means pivotally secured to said upper linkage means and said lower linkage means, said lower linkage means including first pivot means connecting said lower linkage means with said cover and second pivot means connecting said lower linkage means with said bell crank means, and power means for effecting rotation of said bell crank means about said second pivot means, whereby said cover may be rotated into and out of vessel heating position.

2. The apparatus for moving a vessel heater cover of claim 1 including counterweight means fixedly secured to said bell crank means for establishing a moment which through said upper linkage means resists undesired acceleration of said cover as it moves downwardly, and said counterweight means being of sufficient weight to rotate said cover to a generally vertical position when said power means is not energized.

3. The apparatus for moving a vessel heater cover of claim 2 including said cover being in a generally horizontal position when said heater cover is operating and in a generally vertical position when said heater is not operating.

4. Apparatus for moving a vessel heater cover comprising a vessel heating cover, upper linkage means secured to said cover, lower linkage means secured to said cover, bell crank means pivotally secured to said upper linkage means and said lower linkage means, said lower linkage means including first pivot means connecting said lower linkage means with said cover and second pivot means connecting said lower linkage means with said bell crank means, counterweight means fixedly secured to said bell crank means for establishing a moment which through said upper linkage means resists undesired acceleration of said cover as it moves downwardly, said first pivot means of said lower linkage means including gimbal means, said cover being in a generally horizontal position when said heater is operating and in a generally vertical position when said heater is not operating, and power means for effecting rotation of said bell crank means about said second pivot means, whereby said cover may be moved into and out of vessel heating position.

5. The apparatus for moving a vessel heater cover of claim 4 including said gimbal means having a generally T-shaped member which permits rotation of said cover about axes passing through the legs of said T-shaped member, whereby substantially perpendicular axes of rotation of said cover are provided by said T-shaped member.

6. The apparatus for moving a vessel heater cover of claim 5 including said upper linkage means being of adjustable length.

7. The apparatus for moving a vessel heater cover of claim 6 including said upper linkage means having at least two relatively spaced linkage elements each having one end pivotally secured to said cover.

8. The apparatus for moving a vessel heater cover of claim 7 including shaft means passing through said bell crank means, and said linkage elements of said upper linkage means being pivotally secured to said shaft means.

9. The apparatus for moving a vessel heater cover of claim 2 including said power means having a pneumatically or hydraulically actuated cylinder operatively associated with said bell crank means, whereby movement of the piston in a first direction will effect responsive rotation of said bell crank means in a first direction and movement of said piston in a second direction will effect responsive rotation of said bell crank means in the other direction.

10. The apparatus for moving a vessel heater cover of claim 9 including said power means having a pivotally mounted pneumatic cylinder.

11. The apparatus for moving a vessel heater cover of claim 8 including said counterweight means being fixedly secured to said bell crank means.

12. The apparatus for moving a vessel heater cover of claim 1 including said cover having an upper wall and a generally cylindrical circumferential wall, at least one opening in said upper wall for flue means, and at least one opening in said upper wall for cooperating with burner means.

13. The apparatus for moving a vessel heater cover of claim 12 including said upper wall being spaced from the lower extremity of said circumferential wall to provide a combustion chamber between said burner opening and an adjacent vessel.

14. The apparatus for moving a vessel heater cover of claim 13 including compressible, thermal insulating material disposed within said cover, and projecting downwardly below the lower end of said circumferential wall, whereby said thermal insulating material will contact said vessel and be compressively deformed as said cover is lowered into contact with said vessel.

15. The apparatus for moving a vessel heater cover of claim 14 including said thermal insulating material being annularly, substantially continuous to create a substantially continuous contact with said vessel.

16. Apparatus for moving a vessel heater cover comprising a vessel heater cover, upper linkage means secured to said cover, lower linkage means secured to said cover, bell crank means pivotally secured to said upper linkage means and said lower linkage means, said lower linkage means including first pivot means connecting said lower linkage means with said cover and second pivot means connecting said lower linkage means with said bell crank means, stop means associated with said bell crank means for limiting movement of said lower linkage means, and power means for effecting rotation of said bell crank means about said second pivot means, whereby said cover may be moved into and out of vessel heating position.

17. Apparatus for moving a vessel heater cover comprising a vessel heater cover, upper linkage means secured to said cover, lower linkage means secured to said cover, bell crank means pivotally secured to said upper linkage means and said lower linkage means, said lower linkage means including first pivot means connecting said lower linkage means with said cover and second pivot means connecting said lower linkage means with said bell crank means, counterweight means fixedly secured to said bell crank means for establishing a moment which through said upper linkage means resists undesired acceleration of said cover as it moves downwardly, said counterweight means having a pair of spaced weight members connected by beam means, and power means for effecting rotation of said bell crank means about said second pivot means, whereby said cover may be moved into and out of vessel heating position.

18. Apparatus for moving a vessel heater cover comprising a vessel heating cover, upper linkage means secured to said cover, lower linkage means secured to said cover, bell crank means pivotally secured to said upper linkage means and said lower linkage means, said lower linkage means including first pivot means connecting said lower linkage means with said cover and second pivot means connecting said lower linkage means with said bell crank means, said cover having an upper wall and a generally cylindrical circumferential wall, at least one opening in said upper wall for flue means, at least one opening in said upper wall for cooperating with burner means, said upper wall being spaced from the lower extremity of said circumferential wall to provide a combustion chamber between said burner opening and an adjacent vessel, compressible, thermal insulating material disposed within said lower, and projecting downwardly below the lower end of said circumferential wall, whereby said thermal insulating material will contact said vessel and be compressively deformed as said cover is lowered into contact with said vessel, said thermal insulating material being annularly substantially continuous to create a substantially continuous contact with said vessel, said first pivot means of said lower linkage means permitting effective sealing of said thermal insulating material against said vessel, and power means for effecting rotation of said bell crank means about said second pivot means, whereby said cover may be moved into and out of vessel heating position.

19. The apparatus for moving a vessel heater cover of claim 4 including shield means interposed between said linkage means and said cover when said cover is in a closed position.

20. The apparatus for moving a vessel heater cover of claim 4 including said apparatus having a base defining an arcuate recess for receipt of a portion of said vessel, whereby said vessel will be at least partially received within said apparatus.

21. Apparatus for moving a vessel heater cover comprising a vessel heater cover, linkage means for rotating a vessel cover between an operating position and a nonoperating position, power means for moving said linkage means, said cover means having an outer metal shell and an inwardly disposed compressible thermal insulation material, said metal shell having a roof and a depending annular sidewall, and said insulation projecting downwardly farther than said sidewall, whereby said insulation will be compressed upon contact with a vessel wall and establish a seal therebetween.

22. The apparatus for moving a vessel heater cover of claim 21 including said downwardly projecting portion of said insulation being substantially annular and substantially continuous.

23. The apparatus for moving a vessel heater cover of claim 22 including said downwardly projecting portion of said insulation projecting at least about $\frac{5}{8}$ inch beyond the lower end of said sidewall.

24. The apparatus for moving a vessel heater cover of claim 23 including said sidewall terminating in a flange.

* * * * *

UNITED STATES PATENT AND TRADEMARK OFFICE

CERTIFICATE OF CORRECTION

PATENT NO. : 4,389,191

DATED : June 21, 1983

INVENTOR(S) : Richard L. Lowe

It is certified that error appears in the above-identified patent and that said Letters Patent is hereby corrected as shown below:

Claim 18, column 10, line 47, "lower" should be --cover--.

Claim 23, column 12, line 11, "5/8 inch" should be --3/8 inch--.

Signed and Sealed this

*Sixteenth* Day of *August 1983*

[SEAL]

*Attest:*

GERALD J. MOSSINGHOFF

*Attesting Officer*

*Commissioner of Patents and Trademarks*